United States Patent [19]

Saito

[11] 4,254,358

[45] Mar. 3, 1981

[54] INCANDESCENT LAMP

[75] Inventor: Sozo Saito, Tokyo, Japan

[73] Assignee: Kondo Sylvania Kabushiki Kaisha, Tokyo, Japan

[21] Appl. No.: 54,572

[22] Filed: Jul. 3, 1979

[30] Foreign Application Priority Data

Sep. 25, 1978 [JP] Japan ..... 53-131576[U]
Sep. 25, 1978 [JP] Japan ..... 53-131577[U]

[51] Int. Cl.[3] ..... H01J 5/48; H01J 5/50

[52] U.S. Cl. ..... 313/318; 313/315; 339/144 R

[58] Field of Search ..... 313/315, 318; 339/144 R

[56] References Cited

U.S. PATENT DOCUMENTS

| | | | |
|---|---|---|---|
| 2,268,700 | 1/1942 | Criger et al. | 313/318 |
| 2,465,084 | 3/1949 | Greiner | 313/318 X |
| 2,556,059 | 6/1951 | Braunsdorff | 313/318 X |
| 2,615,950 | 10/1952 | Lamb | 313/318 X |
| 3,475,641 | 10/1969 | Ayres | 313/318 X |
| 3,676,730 | 7/1972 | Loughridge et al. | 313/318 |
| 4,145,631 | 3/1979 | Saito | 313/318 |

*Primary Examiner*—Saxfield Chatmon, Jr.
*Attorney, Agent, or Firm*—Wenderoth, Lind & Ponack

[57] ABSTRACT

An incandescent lamp includes a bulb formed of a light-transmissible material, a stem portion for supporting lead-in wires having a filament, and a connector positioned between the bulb and the stem portion to connect them in a hermetically sealed fashion at opposite ends thereof. Since the stem portion is preformed after which the stem is connected integral with the bulb by the connector, it is possible to position the filament as a light source with high accuracy.

5 Claims, 11 Drawing Figures

INCANDESCENT LAMP

BACKGROUND OF THE INVENTION

The present invention relates to incandescent lamps, and more particularly, to an incandescent lamp suitably used as a lamp for projection and as a lamp for recording and reproduction.

In incandescent lamps of the type described, for example, an incandescent lamp for projection used for a projector, it is necessary to position with high accuracy a filament as a light source onto a lens axis of a condensing optical system and a projecting optical system. Also, in a lamp for recording and reproduction, for example, used for optical recording and optical reproduction when a talking picture is taken or projected, it is necessary to position with high accuracy a filament as a light source to a film in order to realize an acoustic effect as expected.

In the past, a proposal has been made to locate a filament of the lamp with high accuracy in connection with an external optical system. In this proposal, the relation between the filament and a base for fixedly holding the filament is not settled due to the difficulty in assembling elements with high accuracy when the lamp is produced. Thus, in this conventional arrangement, a fixing member is disposed externally of the base of the lamp, and the lamp is actually lighted so that the fixing position of the fixing member to the base is adjusted and thereafter both elements are fixed such as by soldering. However, such adjustment and fixation of the fixing member require labor and and is cumbersome.

It is therefore an object of the present invention to provide an incandescent lamp which can accurately position the distance between a reference position of a base and a filament.

It is a further object of the present invention to provide an incandescent lamp which can be produced simply without requiring a complicated process of manufacture.

BRIEF DESCRIPTION OF THE INVENTION

In accordance with the present invention, there is provided an incandescent lamp which comprises a bulb formed of a light-transmissible material, a stem portion for hermetically supporting lead-in wires having a filament fixedly connected to their ends, and a connector positioned between the bulb and the stem portion to connect them in a hermetically sealed fashion at opposite ends thereof. Preferably, the lead-in wires are hermetically supported on the stem portion through a glass stem, and the connector is connected by flanges at opposite ends to the bulb and stem portion.

BRIEF DESCRIPTION OF THE DRAWINGS

The aforementioned and other objects and features of the present invention shall be described hereinafter in detail with reference to preferred embodiments thereof shown in the accompanying drawings, wherein.

DETAILED DESCRIPTION OF THE INVENTION

Figure 1:
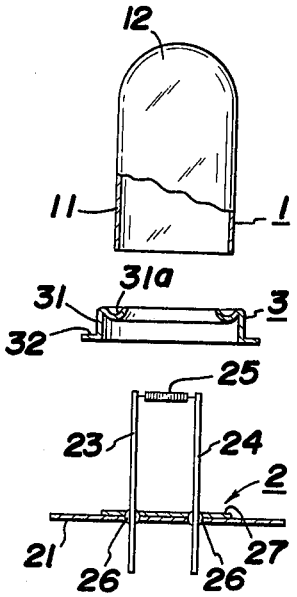
FIG. 1 is an exploded sectional view showing an embodiment of the present invention.

In FIG. 1, the reference numeral 1 designates a bulb, 2 a stem portion and 3 a connector.

The bulb 1 can be glass in which an upper end of a cylindrical portion 11 is closed by a semi-spherical shell portion 12.

Figure 2:
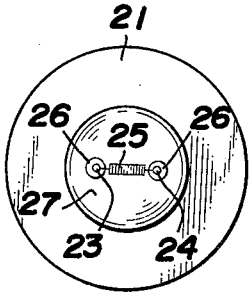
FIG. 2 is a plan view showing a stem portion of the present invention.

On the other hand, the stem portion 2 has, as shown in FIG. 2, for example, a circular metal bed plate 21 and substantially in a central position thereof there is a pair of lead-in wires 23 and 24 fixed through fixing glass beads 26 and 26, respectively. The lead-in wires 23 and 24 upwardly extend form the bed plate 21, and a filament 25 is electrically and mechanically connected fixedly between free ends of the lead-in wires. On the other hand, the lead-in wires 23 and 24 downwardly extend from the bed plate 21, and a power source is connected to extended ends of the lead-in wires so as to give illuminant electric power to the filament 25.

The stem portion 2 may be assembled by the following steps. First, two holes are bored in the bed plate 21, and glass powder with the lead-in wires 23 and 24 inserted therethrough is embedded into the holes, and the unit is then heated in a deposit furnace. Inner surfaces of the holes in the bed plate 21 and portions of the lead-in wires 23 and 24 in contact with the glass powder are preformed with oxide films, and such oxide films may be utilized to provide a deposition with the glass powder so that a hermetically sealed deposition may be obtained between the bed plate 21 and the fixing glass beads 26 and between the fixing glass beads 26 and the lead-in wires 23 and 24. Thereafter, the filament 25 is connected between the free ends of the lead-in wires 23 and 24 to form the stem portion 2.

The connector 3 comprises a metal ring 31, at the lower end of which is formed a flange which extends outwardly at a right angle. The upper end of the metal ring 31 is once bended inwardly and downwardly, after which it is folded back inwardly and upwardly while being curved, to form an annular recess 31*a* which is upwardly open.

Figure 4:
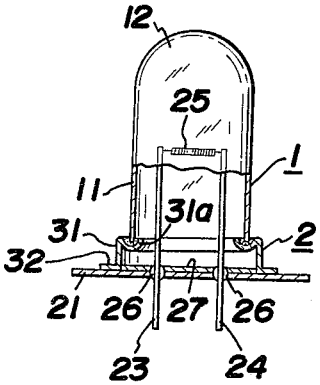
FIG. 4 is a sectional view showing an embodiment of the present invention.

The bulb 1 and stem portion 2 shown in FIG. 1 may be assembled integral with each other through the connector 3 as shown in FIG. 4 in the following steps.

Figure 3:
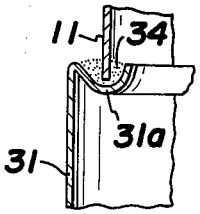
FIG. 3 is a sectional view showing a joining between a bulb and a connector in accordance with the present invention.

First, the annular recess 31*a* of the connector 3 is filled with a glass powder 34 (FIG. 3), into which the lower end of the bulb 1 is inserted, and a connection therebetween is heated. The inner surface of the annular recess 31*a* is preformed with an oxide film, and the oxide film and the lower end of the bulb 1 are hermetically deposited by the glass powder 34.

Next, the bulb 1 is placed to cover the filament 25 so that the flange 32 of the connector 3 may be placed on the bed plate 21 under a vacuum or inactive gases, and the flange 3*a* is cold-deposited on the bed plate 21. Here, an urging material, for example, such as copper foil, is interposed between the flange 32 and the bed plate 21 (for example, such a material is preattached to the undersurface of the flange 32).

It is noted that in positioning the connector 3 on the bed plate 21, if a positioning metal plate 27 slightly smaller in diameter than the inside diameter of the flange 32 of the connector 3 is cold-urged before hand, for example, in the center of the surface of the bed plate 21, it is possible to accurately location the position of the filament 25 relative to the bulb 1. At the same time, if the plate 27 and glass beads 26 are hermetically deposited, reinforcement may be increased much more than the case of only the base plate 21.

Figure 5:
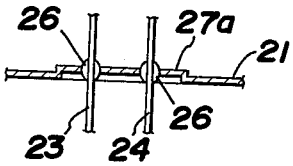
FIG. 5 is a sectional view showing a stem portion of the present invention.

It should be further noted that in place of the positioning metal plate 27 shown in FIGS. 1 and 2, a central portion 27*a* of the bed plate 21 may be protruded upwardly as shown in FIG. 5 to form a peripheral edge, which is utilized to position the bulb 1.

In a manner as described above, an incandescent lamp 4 as shown in FIG. 4 may be obtained.

Although in the above-mentioned embodiment, a description has been given of the case wherein the bulb 1 has no exhaust, it should be noted that if an exhaust is provided assembling of the bulb 1, connector 3 and stem portion 2 may be accomplished in air, after which the air is discharged and an inert gas is introduced and sealed.

In addition, while in the above-mentioned embodiment, cold-urging has been employed to provide an integral structure of the flange 32 and bed plate 21, other metal-to-metal joining processes such as electric welding may also be used.

Moreover, while in the above-mentioned embodiment, the connection between the connector 3 and stem portion 2 has been made through a flange, it is after all necessary to use, as the connector 3, an element designed to produce no mechanical or thermal strain when the bulb 1 is hermetically fixed to the stem portion 2.

As described above, in accordance with the present invention, the stem portion 2 for fixedly holding the filament 25 is preformed, and this portion is connected integral with the bulb 1 by the connector 3 through a metal-to-metal connection to thereby obtain an incandescent lamp wherein the position of the filament 25 fixed between the lead-in wires 23, 24 to the base is positioned with high accuracy. If an arrangement is employed wherein the bulb 1 is deposited on the stem portion 2 directly without the use of the connector 3, there is produced a possible unexpected thermal strain in the stem portion 2, resulting in a possible displacement in position of the filament 25 relative to the base. But in the present invention, such a danger can be effectively avoided.

In addition, according to the present invention, the lead-in wires 23 and 24 are secured to the bed plate 21, which forms a base, by means of the glass beads 26, and thereafter the filament 25 is positioned in connection with the bed plate 21 and, it is therefore possible to eliminate the possibility of displacement of position of the filament 25 due to heat generated when the glass beads 26 are deposited, and as a consequence, positioning of the filament 25 may be achieved with high accuracy without such a displacement in position.

Moreover, in accordance with the present invention, the metal bed plate 21 in the form of a flat plate is used to secure the lead-in wires 23 and 24, and hence it is possible to provide a stem portion 2 which is simple in construction and which is capable of easily determining the distance for positioning the filament 25, and as a consequence, positioning of the filament 25 may be achieved with higher accuracy.

Furthermore, in accordance with the present invention, the bulb 1 is hermetically deposited on the connector through the glass powder filled in the annular recess 31*a* formed in the upper end of the connector, and as a consequence, it is possible to achieve the procedure of hermetical deposition in a more accurate and easier manner.

Figure 6:
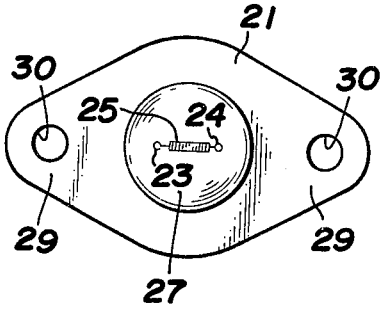
FIG. 6 is a plan view showing a further form of stem portion in accordance with the present invention.

While in the above-mentioned embodiment, the flange 32 of the connector 3 and the metal bed plate 21 have been used merely for a connection between the stem portion 2 and the bulb 1, it is noted that in addition thereto, the flange may be used as an external fixing means for securing the incandescent lamp. For this purpose, for example, the bed plate 21 is provided with lugs 29 as shown in FIG. 6, in which are bored mounting holes 30.

Figure 7:
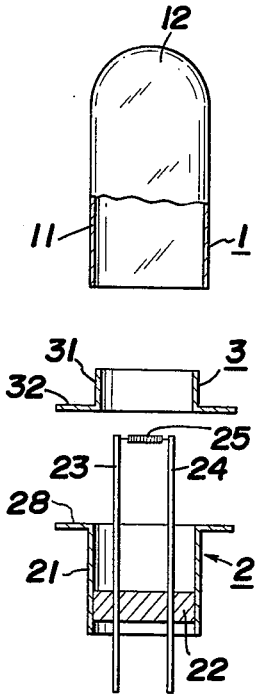
FIG. 7 is an exploded sectional view showing another embodiment of the present invention.

FIG. 7 shows a further embodiment of the present invention. The reference numeral 1 designates a bulb, 2 a stem portion, and 3 a connector.

The bulb 1 can be glass in which an upper end of a cylindrical portion 11 is closed by a semi-spherical shell portion 12.

On the other hand, the stem portion 2 has a metal ring 21 which constitutes a base, and a glass stem 22 is embedded in a lower position interiorly of the metal ring 21. A pair of lead-in wires 23 and 24 are fixed by the stem 22 so that the former may extend opposedly in a vertical direction. On the other hand, the lead-in wires 23 and 24 extend upwardly from the stem 22 and above the metal ring 21, and a filament 25 is fixedly connected electrically and mechanically between the free ends of the lead-in wires. On the other hand, the lead-in wires 23 and 24 extend downwardly from the stem 22 and below the metal ring 21, and a power source is connected to extended ends of the lead-in wires so as to give illuminant electric power to the filament 25.

The stem portion 21 may be assembled by the following steps. First, glass powder to form the glass stem 22 is hardened and is bored with holes to receive therein the lead-in wires 23 and 24, and a resultant member with the lead-in wires 23 and 24 inserted into the holes is inserted into the metal ring 21 and is subjected to heating in a deposit furnace. Inner surfaces of the metal ring 21 and portions of the lead-in wires 23, 24 in contact with the stem 22 are preformed with oxide films, and such oxide films may be utilized to provide a deposition with the glass stem 22 so that a hermetically sealed deposition may be obtained between the metal ring 21 and the stem 22, and between the stem 22 and the lead-in wires 23, 24. Thereafter, the filament 25 is connected between the free ends of the lead-in wires 23 and 24 to form the stem portion 2.

In the upper end of the metal ring 21 in the stem portion 2 is formed a flange 28 which extends outwardly at a right angle.

Figure 9:
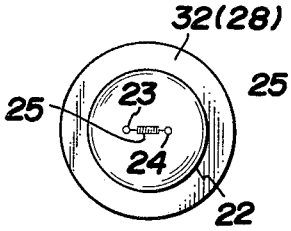
FIGS. 9 through 11 are respectively plan views showing the structure of three connectors in still further embodiments of the present invention.

The connector 3 comprises a metal ring 31, at the lower end of which is formed a flange 32 which extends outwardly at a right angle. The diameter in the outer periphery of the metal ring 31 is selected somewhat smaller than the diameter in the inner periphery of open lower surface of the bulb 1 so that the bulb 1 may be inserted over the metal ring 31. The flange 32 is in a plane shape so that the lower surface thereof is brought into initimate contact with the upper surface of the flange 28 in the stem portion 2. In this embodiment, the flanges 32 and 28 have the same plane shape so that when they are placed one above the other, both are just in coincidence with each other as shown in FIG. 9.

Figure 8:
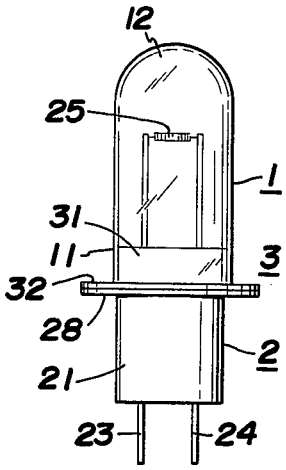
FIG. 8 is a front view showing another embodiment of the present invention.

The bulb 1 and stem portion 2 in FIG. 7 may be assembled integral with each other as shown in FIG. 8 through the connector 3 by the following steps.

First, the bulb 1 is inserted over the metal ring 31 of the connector 3, and a connection therebetween is formed by heating. The metal ring 31 has its outer peripheral surface preformed with an oxide film, and a hermetically sealed deposition is provided between the oxide film and the lower inner surface of the bulb 1.

Next, the bulb 1 is placed to cover the filament 25 of the stem portion 2 so that the flange 32 of the connector 3 may be placed on the flange 28 of the stem portion 2 under vacuum or inactive gases, and the flanges 32 and 28 are cold-deposited. Here, an urging material, for example, such as copper foil, is interposed between the flanges 32 and 28 (for example, such a material is preattached to the undersurface of the flange 32).

In a manner as described above, an incandescent lamp 4 as shown in FIG. 8 may be obtained.

Although in the above-mentioned embodiment, a description has been given of the case wherein the bulb 1 has no exhaust, it should be noted that if an the exhaust is provided assembling of the bulb 1, connector 3 and stem portion 2 may be accomplished in air, after which the air is discharged and an inert gas is introduced and sealed.

In addition, while in the above-mentioned embodiment, cold-urging has been employed to provide an integral structure of the flanges 28 and 32, other metal-to-metal joining processes such as electric welding may also be used.

Moreover, while in the above-mentioned embodiment, the connection between the connector 3 and stem portion 2 has been made through a flange, it is after all necessary to use, as the connector 3, an element designed to produce no mechanical or thermal strain when the bulb 1 is hermetically fixed to the stem portion 2.

As described above, in accordance with the present invention, the stem portion 2 for fixedly holding the filament 25 is preformed, and this portion is connected integral with the bulb 1 by the connector 3 through a metal-to-metal connection to thereby obtain an incandescent lamp wherein the position of the filament 25 fixed between the lead-in wires 23, 24 to the base is positioned with high accuracy. If an arrangement is employed wherein the bulb 1 is deposited on the stem portion 2 directly without the use of the connector 3, there is produced a possible unexpected thermal strain in the stem portion 2, resulting in a possible displacement in position of the filament 25 relative to the base. But in the present invention, such a danger can be effectively avoided.

In addition, according to the present invention, the lead-in wires 23 and 24 are secured to the metal ring 21, which forms a base, by means of the glass stem 22, and thereafter the filament 25 is positioned in connection with the metal ring 21, it is therefore possible to eliminate a possible displacement of position of the filament 25 due to heat generated when the glass stem 22 is deposited, and as a consequence, positioning of the filament 25 may be achieved with high accuracy without such a displacement in position.

Figure 10:
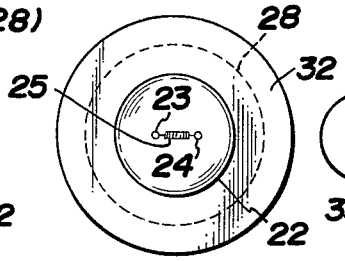
Figure 11:
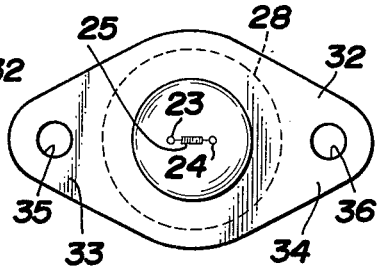

While in the above-mentioned embodiment, the flange 32 of the connector 3 and the flange 28 of the stem portion 2 have been used merely for a connection between the stem portion 2 and the bulb 1, it is noted that in addition thereto, the flange may be used as an external fixing means for securing the incandescent lamp. For example, as shown in FIG. 10, the diameter of the flange 32 of the connector 3 is made larger than that of the flange 28 of the stem portion 2 to form a marginal portion which can be used as a fixing member, and as shown in FIG. 11, the flange 32 in the connector 3 is further provided with lugs 33 and 34 in which mounting holes 35 and 36 are bored.

Furthermore, while in the foregoing, the bulb 1 has been inserted over the outer periphery of the metal ring 31 of the connector 3 to provide a hermetically sealed deposition, it is noted that the bulb 1 may be inserted into the inner periphery of the metal ring 31 instead.

What I claim is:

1. An incandescent lamp comprising:

a bulb formed of light-transmissible material;

a stem portion hermetically supporting lead-in wires having connected to ends thereof a filament; and connector means for connecting said bulb and said stem portion in hermetically sealed fashion, said connector means comprising a member having a first end hermetically joined to said stem portion and a second end having an annular recess receiving an end of said bulb and hermetically joined thereto by fused glass powder substantially filling said annular recess.

2. A lamp as claimed in claim 1, wherein said stem portion comprises a metal plate having said lead-in wires extending therethrough, and glass beads hermetically sealing said lead-in wires to said metal plate.

3. A lamp as claimed in claim 1, wherein said stem portion comprises a metal plate, and said first end of said connector means has an outwardly extending flange sealingly connected to a planar surface of said metal plate.

4. A lamp as claimed in claim 3, wherein said metal plate has thereon a positioning metal plate having an outer periphery dimensioned to receive thereabout and position said first end of said connector means.

5. A lamp as claimed in claim 3, wherein said metal plate includes a raised central portion having an outer periphery dimensioned to receive thereabout and position said first end of said connector means.

* * * * *